US005676610A

United States Patent [19]

Bhatt et al.

[11] Patent Number: 5,676,610

[45] Date of Patent: Oct. 14, 1997

[54] BAT HAVING A ROLLED SHEET INSERTED INTO THE BARREL

[75] Inventors: Dhananjay D. Bhatt, Laguna Hills; Thomas R. Harris, Jr., Anaheim Hills, both of Calif.

[73] Assignee: Hillerich & Bradsby Co., Louisville, Ky.

[21] Appl. No.: 771,967

[22] Filed: Dec. 23, 1996

[51] Int. Cl.[6] ..... A63B 59/06

[52] U.S. Cl. ..... 473/566

[58] Field of Search ..... 473/564–568, 473/457, 105, 169, 170

[56] References Cited

U.S. PATENT DOCUMENTS

| | | | |
|---|---|---|---|
| 1,611,858 | 12/1926 | Middlekauff | 473/566 |
| 3,963,239 | 6/1976 | Fujii | 273/72 |
| 4,600,193 | 7/1986 | Merritt | 273/72 |
| 5,104,123 | 4/1992 | Okitsu et al. | 273/72 |
| 5,114,144 | 5/1992 | Baum | 273/72 |
| 5,364,095 | 11/1994 | Easton et al. | 273/72 |
| 5,415,398 | 5/1995 | Eggiman | 273/72 |
| 5,511,777 | 4/1996 | McNeely | 273/72 |

FOREIGN PATENT DOCUMENTS 5-23407 of 1993 Japan .

*Primary Examiner*—Mark S. Graham

*Attorney, Agent, or Firm*—Middleton & Reutlinger; James C. Eaves, Jr.

[57] ABSTRACT

A bat having a rolled sheet inserted into the barrel of the bat. Preferably the insert is of spring steel and has a width greater than the inside circumference of the bat barrel so that the edges of the insert overlap within the barrel. The insert provides a trampoline effect to the bat that a single wall bat without insert will not have.

19 Claims, 4 Drawing Sheets

BAT HAVING A ROLLED SHEET INSERTED INTO THE BARREL

BACKGROUND OF THE INVENTION

1. Field of the Invention

The present invention relates to a bat having a rolled sheet inserted into the barrel of the bat. Preferably the insert is of spring steel and has a width greater than the inside circumference of the bat barrel so that the edges of the insert overlap within the barrel. The insert provides or significantly enhances a trampoline effect to the bat that a single wall bat without insert may not have.

2. Discussion of the Prior Art

McNeely, U.S. Pat. No. 5,511,777, teaches a bat having a rebounding core therein. FIG. 1*b* teaches a compressed resilient attenuator sleeve 26 between the bat barrel 28 and a tubular shaped inner damper 24, preferably of a rigid material.

Eggiman, U.S. Pat. No. 5,415,398, teaches a softball bat having a tubular insert within the bat barrel. The insert engages the bat toward the two ends of the insert, but therebetween, a gap exists between the bat barrel and the insert. This gap may be filled with a grease.

Easton et al., U.S. Pat. No. 5,364,095, teaches a metal bat having a reinforced fiber composite material on the barrel inside surface. Baum, U.S. Pat. No. 5,114,144, teaches a composite bat which may have an extruded aluminum core. Okitsu et al., U.S. Pat. No. 5,104,123, teaches a metal baseball bat having a layer of resin foam bonded to the inside wall of the barrel impact portion.

Merritt, U.S. Pat. No. 4,600,193, teaches a hollow bat having a spider 33, a geodesic support disposed within a bat. FIG. 6 shows a 6 sided support having inward extending ribs connected at the center. Japan printed specification 5-23407 teaches a bat having an inside pipe 9 with ribs 11 extending inward therefrom.

Fujii, U.S. Pat. No. 3,963,239, teaches a baseball bat having a reinforcing member removably disposed within the barrel portion. FIG. 2 and specification column 3, lines 2–4, teach a tubular cylindrical reinforcing member **16*b*** of metal or plastic. The outer periphery of the reinforcing member is in tight engaging relationship with the inner periphery of the barrel.

SUMMARY OF THE INVENTION

The present invention is for a bat having an insert in the barrel. The insert is formed from a piece of flat sheet having a width greater that the inside circumference of the barrel which will receive the insert. None of the prior art teaches a flat sheet insert which can be rolled (and creased if desired) to a small diameter for easy insertion into the barrel of a bat. The insert can be inserted into a small bore in the end of the barrel or into the handle end of the bat before the knob is inserted thereon. When the rolled insert is released within the barrel of the bat it conforms to the inner surface of the barrel, such that its outer circumference and the barrel inner circumference are virtually identical. Because the width of the insert is greater than the barrel inner circumference, the "width edges" of the insert overlap. These edges can be secured so that the insert acts like a cylinder. The insert can also be secured within the barrel.

Finally, the present invention comprises a bat having a barrel and a handle with a tapered portion therebetween; the barrel having an inside circumference; a flat sheet insert, the insert having a length and a width, the insert being rolled and received within the barrel, the insert engaging the barrel along the length, the width having a value greater than the barrel inside circumference.

BRIEF DESCRIPTION OF THE DRAWINGS

A better understanding of the invention will be had upon reference to the following description in conjunction with the accompanying drawings in which like numerals refer to like parts and wherein.

DETAILED DESCRIPTION OF THE PREFERRED EMBODIMENT

Figures 1A, 1B, 1C, 1D:
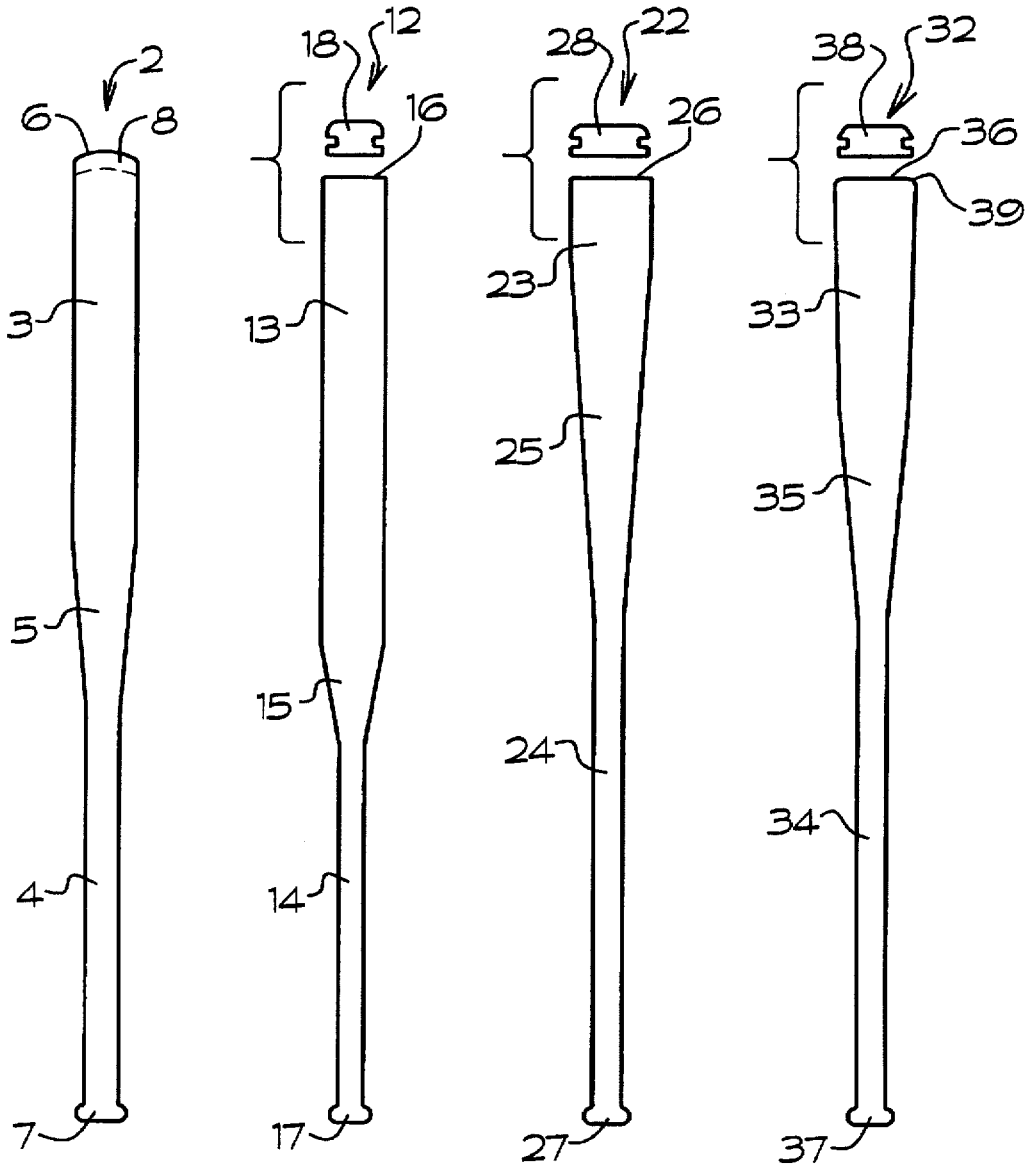
FIG. 1*a* is a bat having a closed end and a uniform diameter barrel.
FIG. 1*b* is a bat having an open end which receives an end cap, the bat having a uniform diameter barrel.
FIG. 1*c* is a bat having an open end which receives an end cap, the bat having a barrel with a uniform diameter portion and a tapered barrel portion.
FIG. 1*d* is a bat having an open end which receives an end cap, the bat having a tapered barrel portion.

In a softball or baseball bat, a spring steel (or equivalent, for example, aluminum or titanium) insert is rolled into a "burrito shape" and inserted into the cap end of a bat. The insert is released to spring into place, flush with the inside of the bat barrel.

With reference to FIGS. 1*a*–1*d*, FIG. 1*a* shows a bat 2, generally used for slow-pitch softball, bat 2 having a uniform diameter barrel 3, a handle 4, a tapered portion 5 between the handle 4 and the barrel 3, a closed end 6 and a knob 7. The closed end 6 may include some form or "end loading" 8, such as a poured rubber-like material or a poured rubber-like material having heavier particles therein. Generally, this material is poured into the handle end of the bat before the knob is attached. For example, a typical softball bat 2 would have a barrel inside diameter ("i.d.") of from 2.060 inches (5.23 cm) to 2.189 inches (5.56 cm) and a barrel wall thickness of from 0.058 inches (0.147 cm) to 0.095 inches (0.241 cm). This equates to a barrel inside circumference ("c"=$\pi\times$i.d.) of from 6.47 inches (16.44 cm) for the 2.060 inch (5.23 cm) i.d. barrel to 6.88 inches (17.47 cm) for the 2.189 inches (5.56 cm) i.d. barrel. Also, barrel 3 of typical softball bat 2 would have a uniform barrel diameter for a length of up to about 14 inches (35.56 cm), depending on the bat. For example, the Hillerich & Bradsby Co. makes a bat like bat 2 in a 34 inch (86.36 cm) length having a barrel length of 10 inches (25.4 cm), 11 inches (27.94 cm), 12 inches (30.48 cm), or 14 inches (35.56 cm).

FIG. 1*b* shows an alternative bat 12, generally used for fast-pitch softball, bat 12 having a uniform diameter barrel 13, a handle 14, a tapered portion 15 between the handle 14 and the barrel 13, an open end 16 and a knob 17. An end cap 18 is generally used to close the open end 16. Generally, the bat has a circumferential groove near the open end 16 and the end cap has a mating circumferential ridge. If desired, some form of end loading can also be employed with this bat. Either the end loading can be incorporated directly into the end cap 18 or, after the end cap is placed on the bat, a rubber-like material with or without heavier particles can be poured into the handle end of the bat, as with the bat of FIG. 1*a*. A typical softball bat 12 would have a barrel inside diameter and inside circumference and barrel wall thickness similar to bat 2, discussed above. For example, the Hillerich & Bradsby Co. manufactures a bat having an overall length of from 28 inches (71.12 cm) to 34 inches (86.36 cm) and a barrel length of from 11 inches (27.94 cm) to 17 inches (43.18 cm).

FIG. 1*c* shows an alternative bat 22, generally used for baseball, bat 22 having a relatively short uniform diameter barrel portion 23 (of about 4 inches (10.16 cm), although this portion could be greater, for example, up to 12 inches (30.48 cm)), a handle 24, a tapered portion 25 between the handle 24 and the uniform portion of the barrel 23, an open end 26 and a knob 27. Again, an end cap 28 is generally used to close the open end 26. If desired, some form of end loading can also be employed with this bat. For example, a typical baseball bat 22 could have a uniform barrel outside diameter of about 2¾ inches (6.99 cm) or of about 2⅝ inches (6.67 cm), or smaller. Generally, bat inside diameters would range from about 2.615 inches (6.64 cm) to 2.093 inches (5.32 cm) and the barrel wall thickness would be from about 0.075 inch (0.191 cm) to about 0.132 inch (0.335 cm). It is noted that the wall thickness for a baseball bat is generally thicker than for a softball bat.

FIG. 1*d* shows an alternative bat 32, generally used for baseball, bat 22 not having any uniform diameter barrel portion. Instead, bat 32 has a first tapered barrel portion 33, a handle 34, a second tapered portion 35 between the handle 34 and the barrel 33, an open end 36 and a knob 37. Again, an end cap 28 is generally used to close the open end 26. As shown, portion 33 could have a maximum outside diameter of 2¾ inches (6.99 cm). Open end 36 tapers down to receive a 2⅝ inch (6.67 cm) end cap 38, shown as reduced diameter curved end portion 39. Again, if desired, some form of end loading can also be employed with this bat.

Figure 2A:
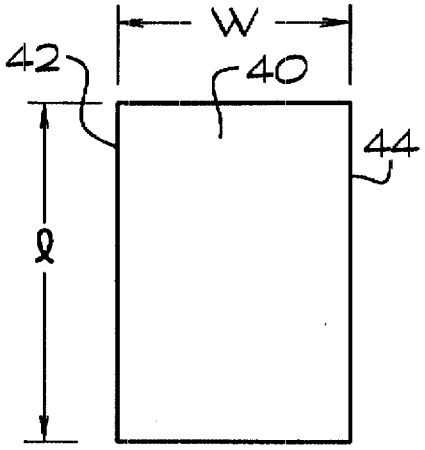
FIG. 2*a* is a rectangular shaped flat sheet insert to be rolled and received into the barrel of a bat.
Figure 2B:
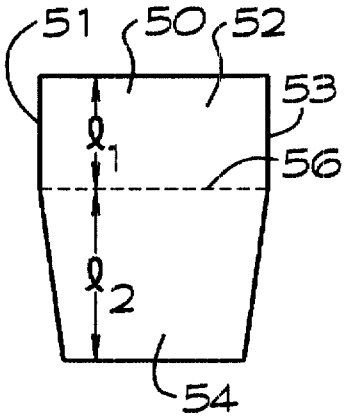
FIG. 2*b* is a flat sheet insert to be rolled and received into the barrel of a bat, the insert having a rectangular shaped portion and a trapezoidal shaped portion.
Figure 2C:
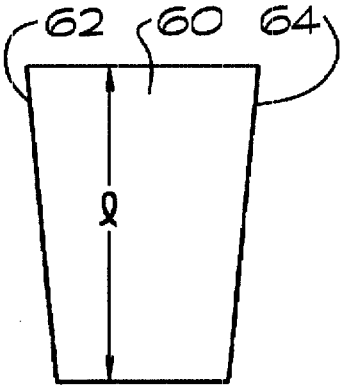
FIG. 2*c* is a trapezoidal shaped flat sheet insert to be rolled and received into the barrel of a bat.
Figure 3A:
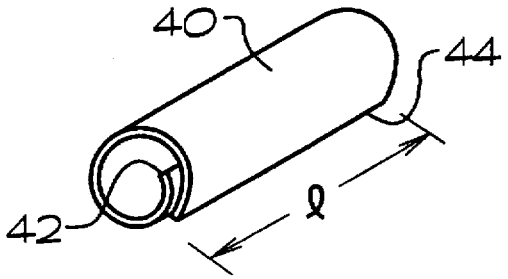
FIG. 3*a* shows the insert of FIG. 2*a* rolled for insertion into a bat.

All of the bats 2, 12, 22, and 32 can receive the insert of the present invention. FIGS. 2*a*–2*c* show three different shaped inserts within the scope of the present invention. The insert 40 of FIG. 2*a* is of rectangular shape, having a length "l" and a width "w". Insert 40 could be used with bats 2, 12, and 32, of FIGS. 1*a*, 11*b*, and 1*d*, respectively. For insertion into the bat, the insert is going to be rolled from left to right, as relative to the view of FIG. 2*a*, so that the insert 40 will appear as in FIG. 3*a*. Rolled insert 40 of FIG. 3*a* has an inner edge 42 and an outer edge 44. The insert 40 has its width selected so that its width exceeds the inside circumference of the bat barrel. This means that edges 42 and 44 overlap when the insert 40 is inside the barrel.

Figure 3B:
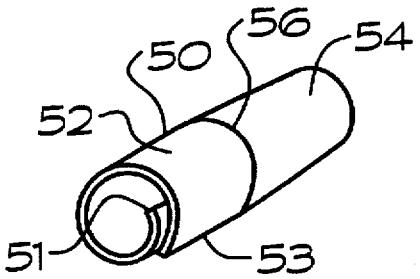
FIG. 3*b* shows the insert of FIG. 2*b* creased and rolled for insertion into a bat.

The insert 50 of FIG. 2*b* is for use with a bat 22 of FIG. 1*c*. Insert 50 has a rectangular shaped portion 52 of length $l_1$ and a trapezoidal shaped portion 54 of length $l_2$. Length $l_1$ is selected to approximate the length of the uniform diameter barrel 23. Trapezoidal shaped portion 54 will taper in relation to the taper of tapered portion 25 of bat 22. So that the insert 50 will fit flush against the inside of the bat 22, a fold or crease 56 will be made between rectangular shaped portion 52 and a trapezoidal shaped portion 54. Insert 50 has a first or inner edge 51 and a second or outer edge 53. As with insert 40, insert 50 is rolled left to right, as seen in FIG. 2*b* to obtain the rolled insert 50 as seen in FIG. 3*b*.

Insert 60 of FIG. 2*c* is the preferred insert for bat 32 of FIG. 1*d*. Insert 60 is of trapezoidal shape and it will taper in relation to the taper of first tapered portion 33 of bat 32. It was mentioned that rectangular insert 40 of FIG. 2*a* could be used with bat 32. However, that is not the preferred insert, as placing a rectangular insert into a tapered barrel will yield an insert where the edges 42 and 44 do not uniformly overlap along the changing diameter of the barrel 33. With insert 60, edges 62 and 64 will uniformly overlap in barrel 33.

Various thicknesses for inserts 40, 50, or 60 can be used, for example, 0.005 inch (0.013 cm), 0.010 inch (0.025 cm), or 0.015 inch (0.038 cm). At this time, we believe about 0.010 inch (0.025 cm) is the preferred thickness. Further, the insert can be made of various materials. We believe that high-carbon 1095, blue-tempered spring steel is the preferred material. However, other steel, titanium, aluminum, other metal, or composite materials such as graphite epoxy materials, and thermoplastic materials may be used. Any material which can be rolled and then expand to engage the interior wall of a bat will be satisfactory and provide some trampoline effect when the bat hits a ball.

The length of the insert 40 "l", 50 "$l_1$ plus $l_2$", and 60 "l" will depend on the hitting zone of the bat. Typical lengths for softball bats would be 10 inches (25.4 cm) or 12 inches (30.5 cm). Typical lengths for baseball bats would be 6 inches (15.2 cm), 8 inches (20.3 cm), or 10 inches (25.4 cm). For insert 50 used in bat 22, $l_1$ would be about 4 inches (10.2 cm). However, these dimensions are given as examples only, and are in no way limiting.

It was previously mentioned that, with insert 40, edges 42 & 44 overlap within the bat, with insert 50, edges 51 & 53 overlap within the bat, and with insert 60, edges 62 & 64 overlap within the bat. The inner circumference the barrel of the bats may be relatively constant, as with bats 2 and 12, may be ever changing, as with bat 32, or may have a uniform circumference portion and a changing circumference portion, as with bat 22. Therefore, the three shaped inserts 40, 50, 60 as was explained before. The width of each insert 40, 50, 60 will exceed the corresponding inner circumference of the bat into which the insert is received to provide this overlap. We have tried bats where the width of the insert is 1.1 times the inner circumference, 1.2 times the inner circumference, 1.6 times the inner circumference, and 2.1 times the inner circumference. All function well and provide a trampoline effect when the bat hits the ball. Even a thin sheets with width 5.1 times the inner circumference could be employed. A first sheet 0.005 inch (0.013 cm) thick with width 2.1 times the inner circumference and a second sheet 0.010 inch (0.025 cm) thick with width 1.05 times the inner circumference, both sheets having the same length, will weigh about the same amount and function similarly. Therefore, many thickness/width combinations are possible within the scope of the invention to achieve the desired result.

Figure 4:
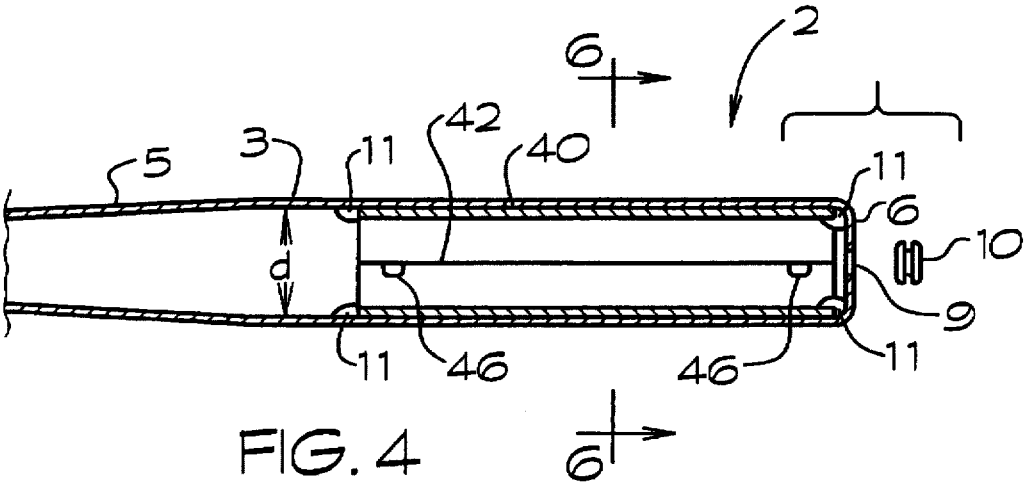
FIG. 4 is a cross section view of a bat portion showing the insert of FIG. 2*a* received by the barrel.

The insert 40, 50, 60 may or may not be anchored within the bat and the insert edges 42 & 44, 51 & 53, and 62 & 64 may or may not be secured to each other. FIG. 4 is a cross-section view of a portion of bat 2 showing insert 40 received within barrel 3, with edge 42 overlapping edge 44. Bat 2 has had a bore 9 made into closed end 6, of less diameter than the bat barrel diameter "d". Generally, bore 9 may have a diameter of 90% or less of d. After the insert is placed into barrel 3, a button 10, of similar function to an end cap, is placed into bore 9 to close the end of bat 2. Alternatively, a resin casting can be used to close the bore 9. This resin casting can also secure the insert.

As shown, insert 40 is anchored within bat barrel 3 with a resin anchor 11, shown at both ends of the insert within the bat barrel. Resin anchor 11, or some other anchor material, may be employed at either end alone. Use at both ends is not required. The insert 40 itself is shown secured at the two location where the insert ends 42 and 44 overlap by tack welds 46. Alternatively, a glue, an adhesive, or a resin can be employed along the edges. This will give the insert the rigidity of a cylinder, to provide uniform hitting response around the bat circumference. Even further, the inside of the barrel can be coated with an adhesive, a glue, or a resin so that when the insert 40 is inserted through bore 9 and expands to diameter "d", the adhesive will secure the insert 40 around its outer circumference to the inner circumference of barrel 3.

Figure 5:
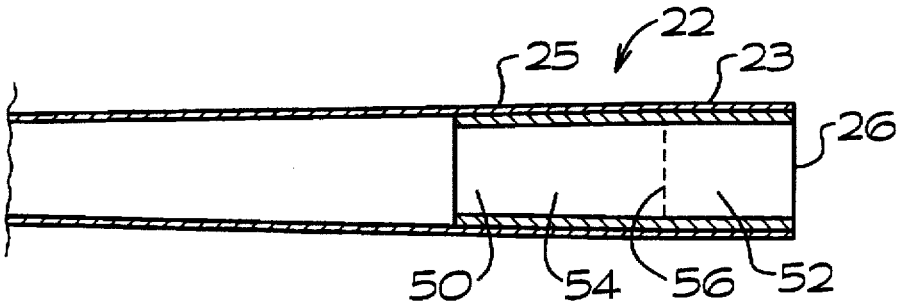
FIG. 5 is a cross section view of a bat portion showing the insert of FIG. 2*b* received by the barrel.

FIG. 5 shows a cross section view of an insert 50 being received into bat 22. This view shows the continuous engagement of insert portion 52 with constant diameter bat portion 23 and of insert portion 54 with varying diameter bat portion 25, as permitted by crease 56.

Figure 6:
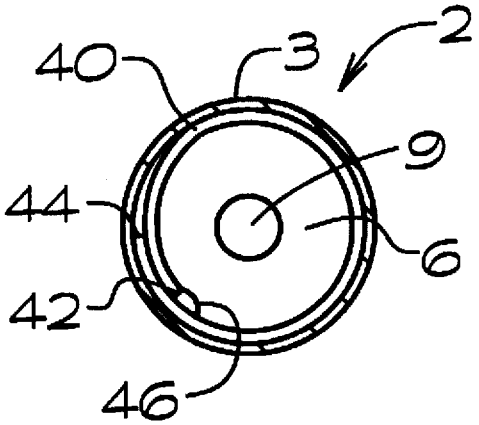
FIG. 6 is a cross section view of the bat of FIG. 4 showing an insert having a width approximately 1.1 times the bat inside circumference; and, FIG. 7 is a cross section view of the bat of FIG. 4 showing an insert having a width approximately 2.1 times the bat inside circumference.
Figure 7:
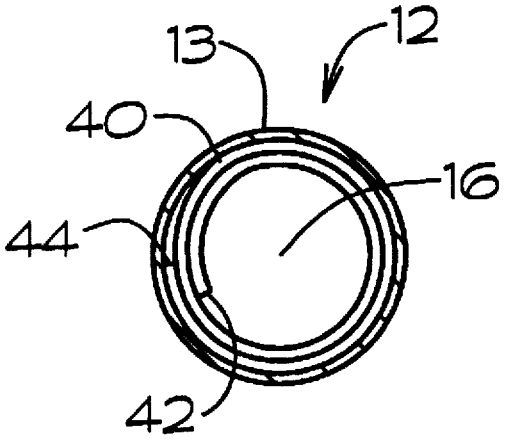

FIGS. 6 and 7 show a cross section view of a bat across the bat axis, the view being 90° from the views of FIG. 4. With the view of FIG. 6, an insert 40 having a width about 1.1 times the inside circumference of barrel 3 is shown received within barrel 3. With the view of FIG. 7, an insert 40 having a width about 2.1 times the inside circumference of barrel 13 is shown received within barrel 13.

In use, when a single wall bat contacts a ball, the bat barrel wall bends or deforms inward. With elastic deformation, the bat barrel wall returns to its normal shape, thereby helping to propel the ball off the bat barrel. If the barrel wall is too thin, plastic deformation can occur such that the barrel wall does not rebound or return to its normal shape. If the barrel wall is too thick, there will be less than the desired amount of elastic deformation and the ball will not be propelled as desired.

With the insert 40, 50, 60, the deformation of the bat barrel wall is lessened. The combined thickness of the barrel and insert and the properties of the bat barrel metal and the insert material determine the deformation.

The foregoing detailed description is given primarily for clearness of understanding and no unnecessary limitations are to be understood therefrom for modifications will become obvious to those skilled in the art upon reading this disclosure and may be made without departing from the spirit of the invention or the scope of the appended claims.

What is claimed is:

1. A bat, comprising: a barrel and a handle, said barrel and said handle having a tapered portion therebetween; said barrel having an inside circumference; a flat sheet insert, said insert having a length and a width, said insert being rolled and received within said barrel, said insert engaging said barrel along said length, said width having a value greater than said barrel inside circumference.

2. The bat of claim 1, said inside circumference having a constant value along said insert length.

3. The bat of claim 1, said inside circumference having a changing value along said insert length.

4. The bat of claim 1, said barrel having a first portion where said inside circumference has a constant value along a first portion of said insert length, said barrel having a second portion where said inside circumference has a changing value along a second portion of said insert length.

5. The bat of claim 1, where said width has a value between 1.1 and 5.1 times said inside circumference.

6. The bat of claim 4, where said insert has a crease between said first portion and said second portion.

7. The bat of claim 1, where said bat barrel has a closed end, said insert being received into said barrel by being inserted through said handle.

8. The bat of claim 1, where said bat barrel has an open end, said insert being received into said barrel by being inserted into said open end, said open end being closed after said insert is inserted therein.

9. The bat of claim 8, said open end having an end diameter and said barrel having a barrel diameter, said end diameter having a value at least equal to 90% of said barrel diameter.

10. The bat of claim 9, said open end being closed after said insert is inserted therein by an end cap.

11. The bat of claim 8, said open end having an end diameter and said barrel having a barrel diameter, said end diameter having a value not exceeding 90% of said barrel diameter.

12. The bat of claim 11, said open end being closed after said insert is inserted therein.

13. The bat of claim 2, said flat sheet insert having a rectangular shape.

14. The bat of claim 3, said flat sheet insert having a trapezoidal shape.

15. The bat of claim 4, said first portion of said flat sheet insert length having a rectangular shape and said second portion of said flat sheet insert length having a trapezoidal shape.

16. The bat of claim 1, said insert being secured within said barrel.

17. The bat of claim 1, said insert received within said barrel having overlapping edges, said overlapping edges being secured.

18. The bat of claim 1, said length having a value between 6 inches (15.24 cm) and 15 inches (38.1 cm).

19. A bat, comprising: a barrel and a handle, said barrel and said handle having a tapered portion therebetween; said barrel having an inside diameter and an inside circumference; a flat sheet insert, said insert having a length and a width, said insert being rolled to a first diameter and being received within said barrel, said first diameter being less than said barrel inside diameter, said insert being expanded to engage said barrel along said length and having an outside diameter equal said barrel inside diameter, said width having a value greater than said barrel inside circumference.

* * * * *